US006008164A

United States Patent [19]

Aldrich et al.

[11] Patent Number: 6,008,164

[45] Date of Patent: Dec. 28, 1999

[54] LUBRICANT BASE OIL HAVING IMPROVED OXIDATIVE STABILITY

[75] Inventors: Haven Scott Aldrich, Annandale, N.J.; Robert Jay Wittenbrink, Baton Rouge, La.

[73] Assignee: Exxon Research and Engineering Company, Florham Park, N.J.

[21] Appl. No.: 09/130,523

[22] Filed: Aug. 4, 1998

[51] Int. Cl.[6] ..... C10M 101/02; C10G 73/44; C07C 5/13

[52] U.S. Cl. ..... 508/110; 208/18; 208/24; 208/95; 208/308; 585/253; 585/738

[58] Field of Search ..... 508/110; 208/18, 208/24, 95, 308; 585/253, 738

[56] References Cited

U.S. PATENT DOCUMENTS

| | | | |
|---|---|---|---|
| 4,832,819 | 5/1989 | Hamner | 208/27 |
| 4,943,672 | 7/1990 | Hamner et al. | 585/737 |
| 5,404,015 | 4/1995 | Chimenti et al. | 250/339.12 |
| 5,419,185 | 5/1995 | Chimenti et al. | 73/54.01 |
| 5,424,542 | 6/1995 | Chimenti et al. | 250/339.12 |
| 5,426,053 | 6/1995 | Chimenti et al. | 436/55 |
| 5,475,612 | 12/1995 | Espinosa et al. | 364/500 |

OTHER PUBLICATIONS

L.M. Petrova, et al, "The Composition and Properties of Lube Oils from Heavy Crudes Produced from Permian Deposits", Chemistry and Technology of Fuels and Oils, vol. 31, Nos. 5–6 (1995), pp. 236–240.

K.I. Zimina, et al, "Method of Comprehensive Investigation of the Composition, Structure and Properties of Oil Hydrocarbons", Scientific Papers of the Prague Institute of Chemical Technology, D 46 (1982), Technology of Fuel, pp. 89–103.

D. Christakudis, et al, "Several properties of Lubricating Oils Produced by Thermaldiffusion", Organic–Technical Chemistry, Chemistry Dept. at the Bergakademie at Freiberg and presented to the 10th International Symposium "Lubricants, Lubrication and Bearing Engineering" (Aug. 27–31, 1998), pp. 32–41.

G.E. Cranton, "Composition and Oxidation of Petroleum Fractions", Elsevier Scientific Publishing Company, Thermochimica Acta (1976), 14 (1–2), pp. 201–208.

G.E. Fodor, "An Analysis of Petroleum Fuels by Midband Infrared Spectroscopy", SAE International Congress (Detroit Feb. 28–Mar. 3, 1994), SAE Meeting Paper (1994), 14 pps.

S. Garrigues, et al., "Multivariate Calibrations in Fourier Transform Infrared Spectrometry for Prediction of Kerosene Properties", Analytical Chimica Acta 317 (1–3) (1995), pp. 95–105.

*Primary Examiner*—Jerry D. Johnson
*Attorney, Agent, or Firm*—Estelle C. Bakun

[57] ABSTRACT

The instant invention is directed to a method for producing a lubricating base stock having a preselected oxidative stability comprising the steps of: (a) separating, into a plurality of fractions based on molecular shape, a hydroisomerized hydrocarbon wax, (b) collecting the fractions of step (a) which have the preselected oxidative stability for use as a lubricating base stock, wherein the fractions to be collected are determined by measuring the oxidative stability of each of said fractions of said plurality of fractions to determine which fractions have said preselected oxidative stability. The invention is also directed to an improved lubricating base oil and a formulated lubricating composition using said lubricating base oil.

6 Claims, No Drawings

LUBRICANT BASE OIL HAVING IMPROVED OXIDATIVE STABILITY

FIELD OF THE INVENTION

The instant invention is directed to a process for the production of high quality lubricant base oils having superior oxidative stability and a high viscosity index.

BACKGROUND OF THE INVENTION

In recent years, the efficiencies of automotive engines have increased significantly in order to conserve fuel and to comply with statutory and regulatory requirements on automotive fuel consumption. This increased efficiency has, in turn, led to more severe service requirements for the engine lubricants because the higher efficiencies have generally been accompanied by higher engine temperatures as well as higher bearing pressures concomitant upon the use of higher compression ratios. These increasingly severe service requirements have made it necessary for lubricant manufacturers to provide superior lubricants. Furthermore, it is expected that this trend will continue and that in the future even more severe service ratings will be established by engine manufacturers. At present, the API "SH" rating is currently employed for passenger car motor oils for gasoline engines and this represents a significant increase in the service requirements of lubricants. Thus, there is a continuing need for lubricants with superior performance characteristics.

One of the performance characteristics which is of greatest significance is the viscosity index (VI). This represents the extent to which the viscosity of a lubricant varies with temperature. Lubricants of high VI change relatively little in viscosity as temperature increases, at least as compared to lubricants of lower VI. Since retention of viscosity at higher temperatures is a desirable characteristic, high viscosity index is desirable. Satisfactory viscosity properties may be conferred either by suitable choice of the lube base stock or by the use of VI improvers which are generally high molecular weight polymers.

The extent to which VI properties can be varied by the use of these improvers is, however, limited because not only are large amounts of improver expensive but the improvers are subject to degradation in use so that service life of lubricants containing large amounts of improver may be limited. This implies that improvements in the VI of the base stock are desirable.

Synthetic lubricants produced by the polymerization of olefins in the presence of certain catalysts have been shown to possess excellent VI values, but they are expensive to produce by the conventional synthetic procedures and usually require expensive starting materials. There is, therefore, a need for the production of high VI lubricants from mineral oil stocks which may be produced by techniques comparable to those presently employed in petroleum refineries.

Studies to date have shown that lubricants prepared via the hydroisomerization of Fischer-Tropsch wax, are equivalent to polyalphaolefins (PAO) except in low temperature performance and base oil oxidative stability. Therefor, a process is needed which is capable of increasing the oxidative stability of hydroisomerized Fischer-Tropsch waxes while producing a lubricant having a high viscosity index (VI).

SUMMARY OF THE INVENTION

The instant invention is directed to a method for producing a lubricating base stock having a preselected oxidative stability comprising the steps of:

(a) separating, into a plurality of fractions based on molecular shape, a hydroisomerized hydrocarbon wax, (b) collecting the fractions of step (a) which have the preselected oxidative stability for use as a lubricating base stock, wherein the fractions to be collected are determined by measuring the oxidative stability of each of said fractions of said plurality of fractions to determine which fractions have said preselected oxidative stability.

More particularly, the invention is directed to a lubricant base oil prepared from a hydrocarbon wax, having improved oxidative stability comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

The invention is likewise directed to a method for producing a lubricating base stock from a hydrocarbon wax having improved oxidative stability comprising the steps of:

(a) Separating, based on molecular shape, the lubricating fraction of a Hydroisomerized hydrocarbon wax to produce a fraction comprising at least 90% of a mixture of branched paraffins wherein said branched paraffins are paraffins having a carbon chain length of about $C_{20}$ to about $C_{40}$, a molecular weight of a bout 280 to about 562, a boiling range of about 650° F. to about 1050° F., and wherein said branched paraffins contain up to four methyl branches and wherein the free carbon index of said branched paraffins is at least about 3.

(b) Collecting said fraction of step (a) for use as a lubricant base oil.

The invention is further directed to a formulated lubricating composition comprising a major amount of a base stock, wherein said base stock substantially comprises a fractionated hydroisomerized hydrocarbon wax comprising a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

DETAILED DESCRIPTION OF THE INVENTION

The preselected oxidative stability as used herein can be any oxidative stability the skilled artisan wishes the lubricating base stock to have. For example, the preselected oxidative stability may be higher or lower than that of the hydroisomerized wax. Preferably, a higher oxidative stability will be sought. The preselected oxidative stability may correspond to that of a particular PAO the artisan wishes to replace with the base stock being produced. It may alternatively be a lower oxidative stability than that of the hydroisomerized wax which would be useful for applications in which high oxidation stability is not desirable. Additionally, the skilled artisan may merely wish to produce a lubricating base stock having a higher oxidative stability than the original hydroisomeinzed wax. In such a case, the artisan may merely survey the oxidative stabilities of the plurality of fractions and collect those fractions showing a maximum across the fractions, discarding the front, back or front and back fractions. Hence, the preselected oxidative stability is whatever the skilled artisan desires it to be and can include a number of the plurality of fractions.

In the instant invention, applicants have identified a fraction having an improved oxidative stability and having the noted characteristics. This was unexpected and previously unknown since a linear relationship in oxidative stability across the fractions separated was expected.

Applicants have discovered that there exists a particular branchy hydrocarbon mixture having a degree of branchiness which confers highly improved oxidative stability to a hydroconverted hydrocarbonaceous feed stock. In the instant invention a highly improved product is obtained from a fractionated hydroisomerized hydrocarbon wax particularly the lubricating, or 700° F.+ fraction of a Fischer-Tropsch wax. The hydrocarbon mixture comprises at least about 90% of a mixture of branched paraffins. Preferably the product will comprise at least about 95% and most preferably, at least about 99% of the mixture of branched paraffins. The mixture of branched paraffins have molecular weights ranging from about 280 to about 562 and boil within the range of about 650° F. to about 1050° F., preferably about 700° F. to about 950° F. The product has a VI of at least about 120. Preferably the branches will be methyl branches. The paraffin mixture is utilizable as a lubricant base oil and has characteristics of viscosity index and oxidative stability making it equivalent to PAO base oils in oxidatives stability performance. Preferably, the paraffins comprising the mixture of branched paraffins will have an average number of pendant carbons of 4 or less. The number of pendant carbons is defined as the number of alkyl groups on the $\epsilon(^{+})$ carbons of the carbon chain. Thus, pendant carbons are present on the carbon chain at positions of at least $\epsilon(^{+})$ from the ends of the carbon chain.

Thus, the instant invention produces a base oil which is more economical and a ready substitute for PAO base oils.

Applicants have unexpectedly found that the oxidative stability of the components of the lubricating fraction of a hydroisomerized Fischer-Tropsch Wax are not the same, nor are they continuous. Rather a maximum exists which has superior oxidative stability.

In the instant invention, the process for producing the product described herein can be any method which separates the lubricating fraction of a hydroisomerized hydrocarbon wax to obtain a product with the desired degree of branchiness as herein disclosed. For example, thermal diffusion separation technique can be utilized along with other separation techniques known to those skilled in the art that separate based on molecular shape.

In the thermal diffusion technique, a mixture of hydrocarbons that range from normal paraffins to highly branched paraffins are separated such that the normal paraffins are eluded first while the most highly branched are eluded last. Branchiness increases as one proceeds to higher polls. One skilled in the art would expect that the most highly branched paraffins would show the least oxidative stability. Synthetic molecules such as PAO's have minimal branching and are used as lubricant base stocks. Applicants have found that this is not the case. Applicants believe, though not wishing to be bound, that a particular level, or mixture of branchiness, can retard the level of oxidation by interfering with the ability of hydroperoxides to react with other reactive hydrogens through steric blocking. Therefore, the random branchiness which result in tertiary hydrogens more reactive in an oxidation environment is being counterbalanced. This is unexpected and previously unknown. Thus, by separating the 700° F.+ fractions to obtain the product herein described, applicants have produced a Fischer-Tropsch lubricant base stock having superior viscosity index and oxidative stability compared to the Fischer-Tropsch base stocks utilized previously.

Though the above discussion is in the context of Fischer-Tropsch waxes, one skilled in the art would recognize that other hydroisomerized waxes can be utilized in the instant process as well.

The hydroisomerized waxes utilizable in the instant invention may originate from any number of sources including petroleum raffinates. Synthetic waxes from Fischer-Tropsch processes may be used, as may be waxes recovered from the solvent or autorefrigerative dewaxing of conventional hydrocarbon oils, or mixtures of these waxes. Waxes from dewaxing conventional hydrocarbon oils, commonly called slack waxes may also be used. All that is necessary is that the waxes be treated, according to the instant invention, to produce a composition having the characteristics herein described.

Though the waxes can be hydroisomerized by conventional prior art methods, typically the hydroisomerization is conducted over a catalyst containing a hydrogenating metal component-typically one from Group IV, or Group VIII, or mixtures thereof. The reaction is conducted under conditions of temperature between about 500 to 750° F. (preferably 500 to 700° F.) and pressures of from 500 to 3000 psi $H_2$ (preferably 500–1500 psi $H_2$), at hydrogen gas rates from 1000 to 10,000 SCF/bbl, and at space velocities in the range of from 0.1 to 10 v/v/hr, preferably from 0.5 to 2 v/v/hr. In the instant invention, preferred catalyst for preparing the Fischer-Tropsch waxes utilizable herein are cobalt catalysts, preferably cobalt/rhenium catalyst. Preferably, the Fischer-Tropsch waxes will be prepared in a slurry reactor utilizing these catalysts. Such catalysts are well described in the literature. Additionally, the catalysts utilized in the hydroisomerization will preferably be a cobalt-molybdenum on an amorphous support, such as a silica-alumina support. Such catalysts are likewise well known in the literature.

Following the hydroisomerization, the isomerate may undergo hydrogenation to stabilize the oil and remove residual aromatics. The resulting product may then be fractionated into a lubricant cut and a fuels cut. Typically, the lubricant cut will boil in the range of about 625° F. to 700° F. or higher. It is the lubricant fraction or cut that is utilized in the instant invention and referred to as the hydroisomerized hydrocarbon wax. For Fischer-Tropsch waxes, the 700° F.+ fraction will typically be used.

In conducting fractionation in the instant method, the degree of branchiness of the desired product is easily measurable using NMR techniques known to those skilled in the art. For example, if thermal diffusion is selected the effluent from each port of the thermal diffusion column can be monitored to determine which ports afford the desired product. The desired product can then be collected from the necessary ports. Additionally, any method known to those skilled in the art for measuring the oxidation induction time can be used to determine the products oxidative stability.

The fraction recovered following molecular shape separation may be further treated if desired. For example, the fraction may be dewaxed to obtain a finished lube.

The free carbon index (FCI) of an isoparaffin base stock can be determined by measuring the percent of methylene groups in an isoparaffin sample using $^{13}C$ NMR (400 megahertz); multiplying the resultant percentages by the calculated average carbon number of the sample determined by ASTM Test Method 2502 and dividing by 100.

The FCI is further explained as follows based on $^{13}C$ NMR analysis using a 400 MHz spectrometer. All normal paraffins with carbon numbers greater than $C_9$ have only five non-equivalent NMR adsorptions corresponding to the terminal methyl carbons ($\alpha$) methylenes from the second, third and forth positions from the molecular ends ($\beta$, $\gamma$, and $\delta$ respectively), and the other carbon atoms along the backbone which have a common chemical shift ($\epsilon$). The intensities of the $\alpha$, $\beta$, $\gamma$ and $\delta$ are equal and the intensity of the $\epsilon$ depends on the length of the molecule. Similarly the side branches on the backbone of an iso-paraffin have unique chemical shifts and the presence of a side chain causes a unique shift at the tertiary carbon (branch point) on the backbone to which it is anchored. Further, it also perturbs the chemical sites within three carbons from this branch point imparting unique chemical shifts ($\alpha'$, $\beta'$ and $\gamma'$).

The FCI is then the percent of $\epsilon$ methylenes measured from the overall carbon species in the $^{13}C$ NMR spectra of the base stocks as calculated from ASTM method 2502, divided by 100.

The Fischer-Tropsch lube fractions which can be separated to obtain the base oil of the instant invention are those prepared in accordance with the prior art. Preferably the 700° F. fraction will be separated.

The lubricating oil of the instant invention is comprised of a major amount of the lubricating base stock derived from a Fischer-Tropsch wax comprising a mixture of branched paraffins, wherein said branched paraffins are paraffins having a carbon chain length of about $C_{20}$ to about $C_{40}$, a molecular weight of about 280 to 562, a boiling range of about 650° F. to about 1050° F., and wherein said branched paraffins contain up to four alkyl branches and wherein the free carbon index of said branched paraffins is at least about 3. Additionally, the lubricating formulation will contain a minor amount of other additives known to those skilled in the art.

As used herein the term major amount is intended to mean that when a composition has a major amount of a specific material that amount is more than 50% by weight of the composition. A minor amount is less than 50% of the composition.

The additives utilized in the lubricating formulation are those that will supply the characteristics that are required in the formulation. Among the types of additives are included viscosity improvers, other VI improvers dispersants, antioxidants, corrosion inhibitors, detergents, ashless dispersants, pour point depressants, antiwear agents, friction modifiers, etc.

By substantially comprising is meant at least about 50%.

The following examples are merely for illustration and are not meant to be limiting in any way.

EXAMPLE 1

A sample of Fischer-Tropsch wax was subjected to hydroisomerization under hydroconversion conditions which were sufficient to convert ≥50% of the 700° F.+ wax into high quality liquid transportation fuels. The resulting 700° F.+ material was then fractionated into a 700–950° F. and solvent dewaxed. The Lubricant was then fractionated by thermal diffusion into cuts. In this example 10 thermal diffusion cuts were produced at ports 1–10 (P1–P10). The feedstock and the cuts were evaluated to measure their oxidative stability using High Pressure Differential Scanning Calorimetry (HPDSC). The stability of the cuts was not equal and showed a maximum between cuts from ports P4–P7. The P4–P7 cuts were those having the degree of branchiness herein described. Thermal diffusion cuts from ports P1, P2, P3, P8, P9, and P10 had significantly lower oxidation stability as measured using oxidation induction time (OIT) and did not meet the degree of branchiness criteria desired.

The Lubricant 700–950° F. stream was also separated into narrow cuts by conventional 1515 distillation that were also evaluated using HPDSC. OIT's for the distillate cuts did not show any trend that suggested there was a beneficial distillation temperature or boiling point and therefore molecular weight dependence for improved oxidation stability. Consequently, separation techniques such as distillation are not effective for isolating a selective cut that is superior.

HPDSC is a calorimetric technique in which the Lubricant base oil cuts can be measured to determine induction times. OIT's are measured in minutes for experiments that are conducted isothermally. These experiments were conducted between 190° C. and 210° C. Each cut or Lubricant base oil sample was blended with a fixed amount of amine antioxidant known to inhibit oxidation. The induction period that is measured reflects the amount of time, in minutes, that the amine antioxidant is consumed. The rate at which it is consumed depends on the relative oxidizability of the fluid in which it is dissolved. Hydrocarbons that are easily oxidized produce high levels of hydroperoxides and other oxidation products. The amine antioxidants scavenge radicals derived from these components and prevents the onset of an autocatalytic reaction until the amine is consumed. The more oxidizable the fluid, the faster the amine antioxidant is consumed and the shorter the OIT. Consequently, thermal diffusion cuts that have long OIT's have higher oxidation stability.

Each sample from Example 1 was blended with a constant amount of dioctyl diphenyl amine antioxidant. The concentration of antioxidant was 0.5 wt % on the base oil in each case. The samples were evaluated in open aluminum pans under 200 psi of $O_2$ at constant temperature and the stability was measured by the oxidation induction time (OIT) in minutes. The longer the OIT for a cut at a fixed temperature, the more stable is that lubricant thermal diffusion cut. Each thermal diffusion cut was evaluated at 170° C. and 180° C. The relative stability is determined by comparing OITs at a fixed temperature. The stability of the cuts was not equal and showed an increase between ports 2 and 6 followed by a steady decrease after that.

The results are shown in Table I.

TABLE I

| Port Number | HPDSC Isothermal Temperature, ° C. | Oxidation Induction Time (Minutes) |
|---|---|---|
| 1 | 170 | 21.0 |
| 1 | 180 | 14.4 |
| 2 | 170 | 32.4 |
| 2 | 180 | 14.8 |
| 3 | 170 | 25.2 |
| 3 | 180 | 15.1 |
| 4 | 170 | 37.4 |
| 4 | 180 | 20.7 |
| 5 | 170 | 34.6 |
| 5 | 180 | 19.0 |
| 6 | 170 | 32.8 |
| 6 | 180 | 16.0 |
| 7 | 170 | 25.1 |
| 7 | 180 | 13.3 |
| 8 | 170 | 16.4 |
| 8 | 180 | 10.1 |
| 9 | 170 | 15.6 |

TABLE I-continued

| Port Number | HPDSC Isothermal Temperature, ° C. | Oxidation Induction Time (Minutes) |
|---|---|---|
| 9 | 180 | 10.0 |
| 10 | 170 | 15.3 |
| 10 | 180 | 10.5 |

The sample of hydroisomerized Fischer-Tropsch wax from Example 1 was thermally diffused and analyzed. The results are shown in Table II.

TABLE II

| Port # | P3 | P5 | P7 | P9 |
|---|---|---|---|---|
| Total Attachments | 3.46 | 3.14 | 4.19 | 3.59 |
| Attachments for C-4 to C-22 | 1.48 | 1.54 | 1.86 | 1.62 |
| Methyl Attachments | 2.36 | 2.21 | 2.8 | 2.35 |
| Attachments Longer Than Methyl | 1.1 | 0.93 | 1.39 | 1.64 |
| Free Carbon Index | 3.99 | 3 | 2.96 | 2.35 |
| Number of Terminal Carbons | 0.61 | 0.4 | 0.74 | 0.9 |
| Number of Pendant Carbons | 2.94 | 3.19 | 4.58 | 4.9 |
| Average Length of Attachments | 1.11 | 1 | 1.1 | 1.4 |

P = Port

The results show the properties of the cuts.

What is claimed is:

1. A lubricant base oil prepared from a Fischer-Tropsch wax, having improved oxidative stability comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

2. The lubricant base oil of claim 1 wherein said alkyl branches are methyl branches.

3. The lubricant base oil of claim 1 wherein said base oil has an oxidative stability as measured by HPDSC at 170° C. of at least about 20 minutes.

4. The lubricant base oil of claim 1 wherein said base oil has a viscosity index of at least about 120.

5. A method for producing a lubricating base stock from a Fischer-Tropsch wax having improved oxidative stability comprising the steps of:

(a) Separating the 700° F.+fractions of a Hydroisomerized Fischer-Tropsch wax to produce a composition comprising at least 90% of a mixture of branched paraffins wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3, (b) Collecting said composition of step (a) for use as a lubricant base oil.

6. A formulated lubricating composition comprising a major amount of a base stock, wherein said base stock substantially comprises a fraction of a 700° F.+fraction of a hydroisomerized Fischer-Tropsch wax comprising a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

* * * * *